United States Patent [19]

Takatori et al.

[11] Patent Number: 4,620,494

[45] Date of Patent: Nov. 4, 1986

[54] CONVEYOR FOR USE IN CARRYING LEG PARTS OF HALF MADE PANTYHOSE IN AN INTEGRATED PANTYHOSE SEWING MACHINE

[76] Inventors: Oushou Takatori, 1516-9, Sekiya, Kashiba-cho, Kitakatsuragi-gun, Nara; Osami Kanda, 148-5, Iwami, Miyake-cho, Shiki-gun, Nara; Kunihiro Kitamura, 365, Imaki, Ohyodo-cho, Yoshino-gun, Nara, all of Japan

[21] Appl. No.: 791,996

[22] Filed: Oct. 23, 1985

[30] Foreign Application Priority Data

Oct. 24, 1984 [JP] Japan ..... 59-224638

[51] Int. Cl.[4] ..... D05B 21/00

[52] U.S. Cl. ..... 112/121.15; 223/43

[58] Field of Search ..... 112/121.15, 121.12, 112/121.11, 2; 223/43, 112

[56] References Cited

U.S. PATENT DOCUMENTS

| | | | |
|---|---|---|---|
| 4,383,490 | 5/1983 | Hodges | 112/121.15 |
| 4,383,491 | 5/1983 | Hodges | 112/121.15 X |
| 4,444,140 | 4/1984 | Moyer | 112/121.15 X |
| 4,541,351 | 9/1985 | Horita et al. | 112/121.15 X |
| 4,549,493 | 10/1985 | Gazzadrini | 112/121.15 |
| 4,558,653 | 12/1985 | Horton et al. | 112/121.15 X |
| 4,566,615 | 1/1986 | Nakahira | 112/121.15 X |

*Primary Examiner*—H. Hampton Hunter

*Attorney, Agent, or Firm*—Wenderoth, Lind & Ponack

[57] ABSTRACT

This invention concerns a belt conveyor for delivering pantyhose whose panty part only has just been seamed by a panty part sewing machine to a toe part sewing machine in order for the leg part to be received smoothly. When the half made pantyhose are on their way to the toe part sewing machine with the panty part held by clipping members and the leg parts dangling from a guide pipe of the panty part sewing machine, the belt conveyor, disposed between both the paths of clipping members of the panty part sewing machine and suction members of the toe part sewing machine, correctly receives the leg parts one by one in association with a guide member disposed in contact with the belt conveyor at a little time interval. One of the leg parts, received by the belt conveyor first, is delivered, by their suction, to the suction members then coming nearby; the other is delivered in the same way a little later. The belt conveyor moves back and forth to carry the leg parts and return to the original position in such exact synchronization with the circular movement of the clipping members of the panty part sewing machine and the suction members of the toe part sewing machine that the delivering can be made without failure despite the fact that leg parts of pantyhose are so light and soft as fluttering by a slight air stream. Also, the separate sewing system, conventionally made for panty part and leg parts, can be joined together by the exact delivering of the belt conveyor, with the result that the rationalization in hosiery workshops, including the process control and labor-saving, can surely be achieved to the greatest extent.

4 Claims, 12 Drawing Figures

CONVEYOR FOR USE IN CARRYING LEG PARTS OF HALF MADE PANTYHOSE IN AN INTEGRATED PANTYHOSE SEWING MACHINE

This invention relates to a conveyor built in an integrated pantyhose production line uniting a panty part sewing machine and a toe part sewing machine so as to deliver half made pantyhose from one to the other. More specifically, this invention relates to a conveyor for delivering pantyhose whose panty part only has just been seamed up by a panty part sewing machine to a toe part sewing machine by carrying their leg part, dangling from a guide pipe of said panty part sewing machine, to two successive suction members of said toe part sewing machine one by one and causing said suction members to surely suck and receive both the leg parts from said panty part sewing machine in order to seam their top up to complete pantyhose by said toe part sewing machine.

Generally, in the pantyhose production line, a couple of hose 1, 2 made of filament, usually a couple of circular knit, are first seamed up side by side to form a panty part by a panty part sewing machine as shown in FIG. 7(A) and then their still open two ends 4*a*, 5*a* are seamed separately to give a toe part 4*a*, 5*a* by a toe part sewing machine, as shown in FIG. 7(B). Thus, a pair of complete pantyhose is manufactured as shown in FIG. 7(C). As apparent from the above, a pair of pantyhose is manufactured by way of two separate sewing processes: panty part and toe part sewing processes. As a matter of course, these two kinds of sewing machine have so far been well known in the hosiery industry and in fact put widely to practical use.

On account of such separate pantyhose production system, the machines are also independently constructed as a monofunctional sewing machine, so to speak. Thus, not only is at least one person required to manipulate each machine but one more person is needed to carry half made pantyhose to a toe sewing machine. Consequently, in workshops that employ a number of these machines in pairs, such a considerably greater amount of time and labour is wasted to load the half made products on trucks or deliver them to every toe part sewing machine that it has so far been a main cause of hampering the rationalization of the pantyhose production. The situation being such that creating a novel integrating system has strongly been awaited from not only the rationalization but the labour-saving point of views.

Under the circumstances, an integrated pantyhose sewing process and an apparatus for achieving the same the present applicant has first developed are truly those that satisfy such a longstanding strong wish in the hosiery industry as the above. That is, the above process and the apparatus comprise disposing a toe part sewing machine beside a panty part sewing machine, connecting the two sewing machines with a delivering member, causing two successive suction members provided to the toe part sewing machine to suck a pair of dangling leg parts of pantyhose whose panty part only has been seamed but still held by clipping members, causing a pair of holders provided to the toe part sewing machine to move back and forth, by the action of the delivering member, in order to hold, turn inside out, put on and automatically deliver to the two successive suction members the half made pantyhose.

Incidentally, the most essential point of the above process and the apparatus consists in how exactly, in both timing and place, a delivering member can take leg parts of the half made pantyhose to two successive suction members of the toe part sewing machine one by one immediately before delivering the pantyhose. That is, unless either of the leg parts is correctly sucked by the suction members, not only does the next delivering fall into trouble but it makes sewing toe part entirely impossible.

In view of this, according to the above process and apparatus, a holder to lift dangling leg parts up to near the delivering point is provided in order to help them being sucked one by one into the suction members which come near the delivering point one after another at a certain interval. But, since the leg parts are also approaching to the delivering point at this moment, dangling from a clipping member, the holder has to lift them up in an exact timing; for this, the leg parts also have to arrive at the delivering point at the same interval. However, because of being very light and soft, they are very easy to flutter if there is even a faint air stream in the plant, for example, which, in fact, used to be a cause for them to miss the timing of being sucked into the suction members. Moreover, the two successive suction members are not separated so away that the leg parts tend to tangle with each other or be sucked together into one suction pipe merely by lifting them up one by one within a very short period of time.

Accordingly, it is an object of this invention to provide a conveyor that holds leg parts of half made pantyhose dangling from a guide pipe of a panty part sewing machine for a moment, forcibly carries them to suction members coming near a delivering point and causes them to suck them one by one for sure. It is another object of this invention to provide a conveyor simple in structure but very exact in timing of making two successive suction members suck leg parts of half made pantyhose, being transferred from a panty part sewing machine one by one. The above and other objects and features of this invention will appear more fully hereinafter from a consideration of the following description taken in connection with the accompanying drawing wherein one example is illustrated by way of example.

FIGS. 4(A) to (D) are illustrations showing the action of the conveyor of this invention.

Figure 5:
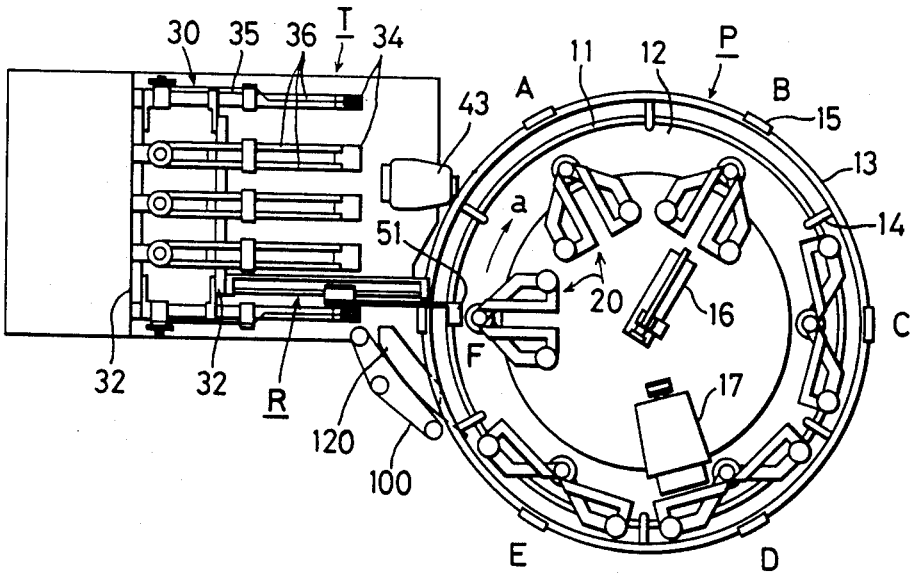

FIG. 5 is a schematic plan view showing the conveyor of this invention is disposed on an integrated pantyhose sewing apparatus which is constructed of a panty part sewing machine, a toe part sewing machine and a delivering member.

Figure 6:
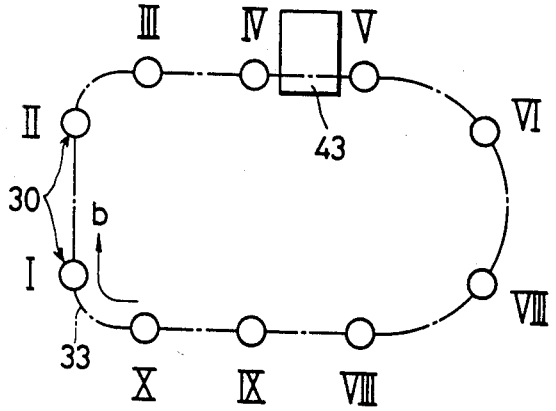

FIG. 6 is a schematic elevation showing an arrangement of suction members at each position of a toe part sewing machine.

Figure 7A:
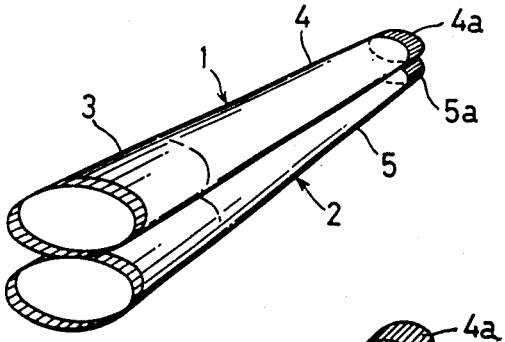
Figure 7B:
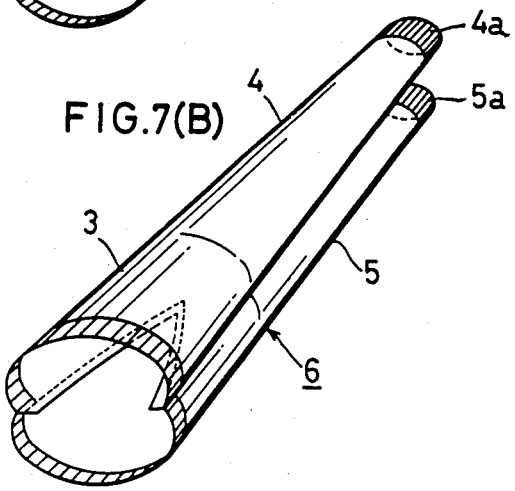
Figure 7C:
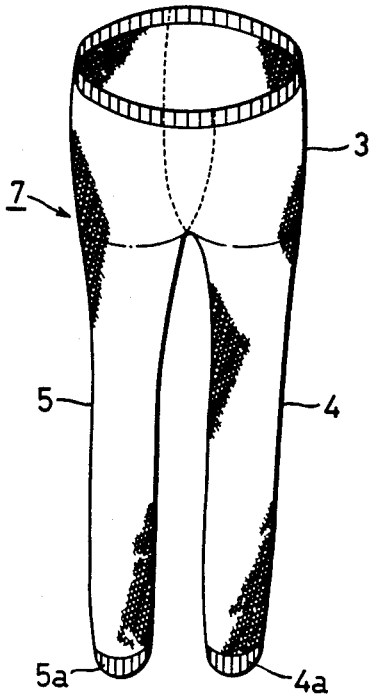

FIGS. 7(A) to (C) are perspective illustrations showing a process of producing a pair of pantyhose.

As mentioned above, FIG. 5 is a schematic plan view showing a construction of an integrated sewing apparatus of this invention, wherein the letter P designates a panty part sewing machine; the letter T designates a toe part sewing machine; and the letter R designates a delivering member for half made pantyhose provided to a junction part of the panty part sewing machine P and the toe part sewing machine T. A belt conveyor 100 and a guide member 120 both of which comprise an essential part of the apparatus of this invention are disposed on one side of the delibering member R. In order to make the following description comprehensible, the construction of the panty part sewing machine P, the toe part sewing machine T and the delivering member R will be explained in more detail.

As shown in FIG. 5, in the panty part sewing machine P a narrow, ring-formed carrier 12 is provided slidably to a guide rail 11 which has a circular trajectory; attached to the carrier 12 is a guide pipe 13 whose diameter is greater than that of the guide rail 11 with fixing members 14. A plurality of clipping members 20, each of which is constructed of a pair of right and left clipping plates and a pair of upper and lower clipping plates, are fixed to the carrier 12 at a certain interval. (In this case, FIG. 5 shows six clipping members are provided to the carrier.) The clipping members 20 turn in the arrow-headed direction (a) in conjunction with the guide pipe 13 as the carrier 12 turns; they stop at six stations A to F on the guide rail 11 one after another. At the station A one of the clipping members clips a pair of tubular hose 1, 2 together; it mounts one of the hose on the upper clipping plate and the other on the lower clipping plate. At this moment lower parts of the tubular hose 4-4*a*, 5-5*a*, which form a leg part of pantyhose later, loosely hang down from the guide pipe 13 with a separator 15 put between them. A cutter 16 capable of rotating in association with the carrier 12 cuts both their upper parts so as to give there a crotch part of pantyhose later, traveling between the staions B and C. The right and left clipping plates then open so as to make the cut turn outside. A sewing machine 17 seams up the cut while the clipping member transfers from the station D to E. In this way, a pair of half made pantyhose 6 is produced with its toe part still unseamed as shown in FIG. 7(B). The right and left clipping plates turn back to the original parallel condition from the open condition while the clipping member travels from the station E to F in order to release the half made pantyhose therefrom.

The toe part sewing machine T, which is shown in FIGS. 5 and 6, is provided with a pair of elongated circular frames 32, 32 between which is disposed an elongated circular endless belt 33 on which a plurality of suction members 30 are placed. (In this case, FIG. 6 shows ten suction members.) Each suction member 30 is constructed of a suction pipe 35 with a suction head 34 on its top and a pair of finger pieces 36, 36 fitted on the suction pipe 35, which can slide thereon in the axial direction. Also, the suction members 30 can rest on the positions I, II, . . . , X on the endless belt 33 one after another, moving in the arrow-headed direction (b) by means of an appropriate driving means as shown in FIG. 6.

At first, the leg parts 4, 5 of the above mentioned half made pantyhose 6, shown in FIG. 7(B), are sucked one by one into each suction pipe 35 of two successive suction members 30, 30 staying at the position I and II. At the same time, the two suction members are covered with the panty part of the pantyhose turned inside out. After that, while the suction members travel from the next position III through the positions IV, V, . . . , IX to the last position X, every work necessary for seaming up the toe part is finished respectively at each position; as a result, a pair of complete pantyhose is produced as shown in FIG. 7(C).

Meantime, the delivering member R is disposed on a line connecting the station F, where the clipping member 20 stays, and the positions I and II, where the successive suction members stay in pairs for a while, so as to be movable back and forth. (As a matter of fact, half made pantyhose 6 is delivered on the line.) Also, a pair of holders 51, 51 are provided to the delivering member R swingably in a plane perpendicular to the direction in which it moves back and forth, whereby the half made pantyhose 6, of which leg parts 4, 5 have already been sucked into the suction pipe 35 respectively, is delivered from the panty part sewing machine P to the toe part sewing machine. (FIG. 5 shows an upper holder 51 only.)

Figure 1:
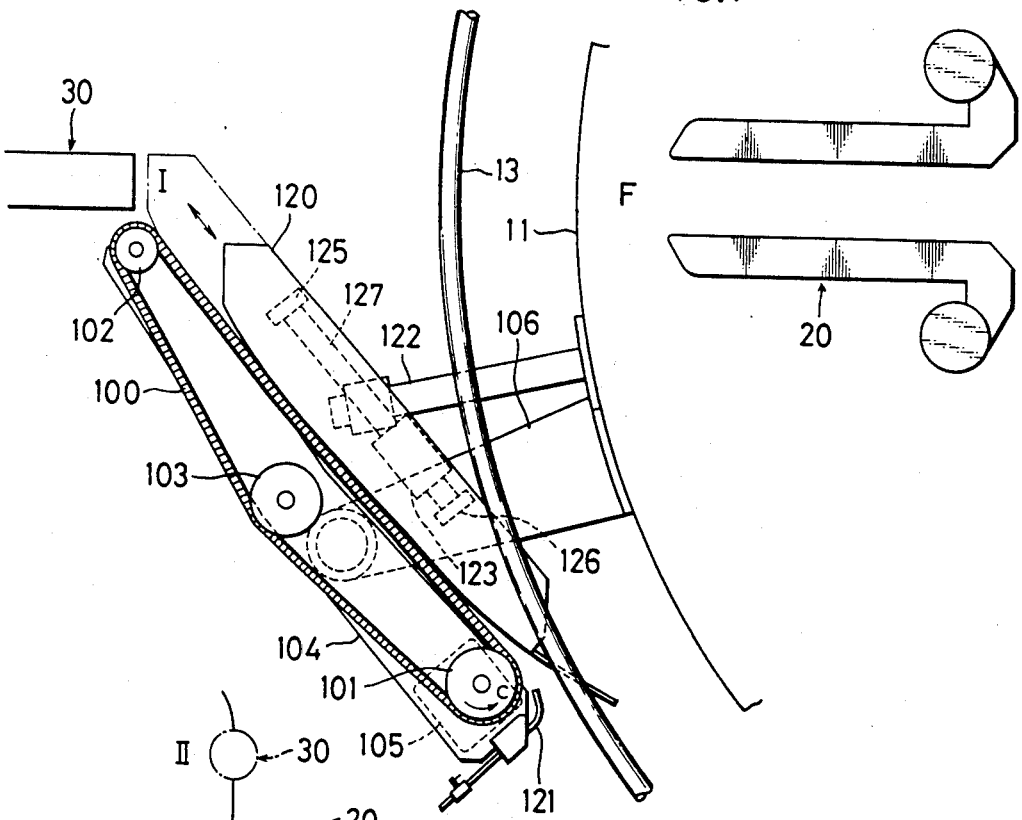
FIG. 1 is a plan view showing a conveyor of this invention.
Figure 1:
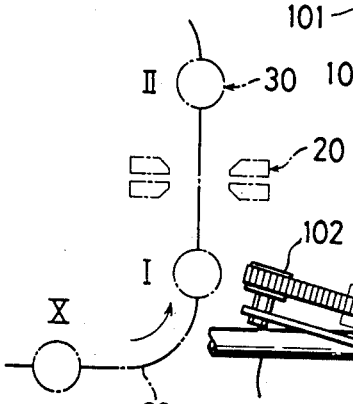
Figure 2:
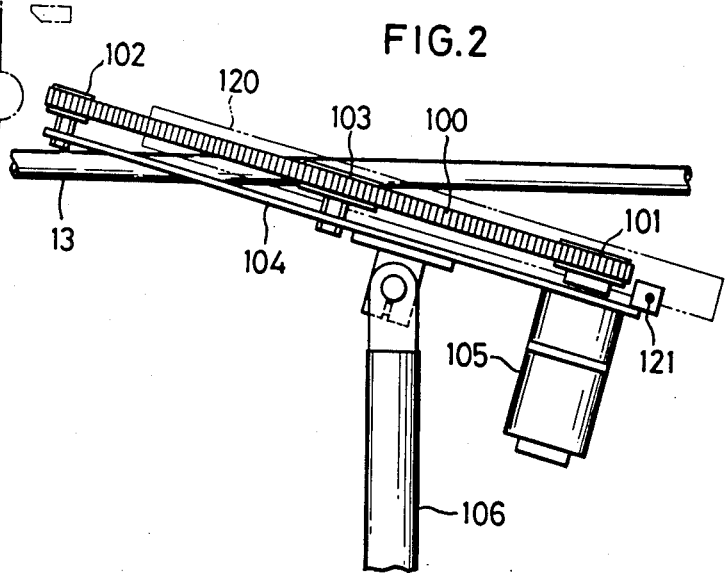
FIG. 2 is a side view of the same conveyor of this invention.

Referring now to FIGS. 1 and 2, the apparatus of this invention will be described. In the figures, the numeral 100 designates an endless belt conveyor which spans a driving puley 101 and a driven puley 102. The endless belt conveyor 100 is installed beside where the delivering of the half made pantyhose is conducted by the delivering member R. To put it more particularly, one end of the belt conveyor, on the side of driving puley 101, is placed between the stations E and F of the panty part sewing machine and a little outside under the guide pipe 13; the other, on the side of the driven puley 102, is placed almost right under the suction member 30 that stays at the position I of the toe part sewing machine T. The numeral 103 designates a medium puley used to adjust tension of the belt conveyor 100, where the medium puley, together with the driven puley 102, is attached rotatably to a supporting plate 104 with a bearing. A motor 105 is fixed to the under surface of the supporting plate and the driving puley 101 is fastened to the rotary shaft of the motor. Such is the frame work that the belt conveyor 100 beings to turn in the arrow-headed direction (c) by the driving puley 101, as shown in FIG. 1, when the motor 105 is energized. In connection with the above, the supporting plate 104 is supported by a bracket 106 fixed to the guide rail 11 of the panty part sewing machine P.

The numeral 120 designates a guide member which is placed so closely to the belt conveyor 100 that one side thereof is always in contact with the surface of the conveyor's belt. One end of the guide member 120 makes a gentle curve almost parallel to the circular guide pipe 13; consequently, there forms a V-shaped opening between the same end and the conveyor's belt, where a nozzle 121 is disposed in order to put the leg parts of the half made pantyhose 6, dangling from the guide pipe 13, in the V-shaped opening by an air jet therefrom.

Figure 3:
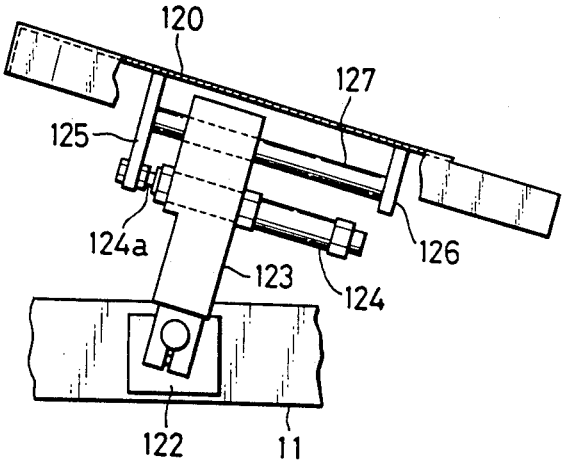
FIG. 3 is a partially cutaway side view showing detail of a stroking mechanism of a guide member to be put in contact with the same conveyor.

As shown in FIGS. 1 and 3, a supporting bracket 122 is fixed to the guide rail 11 and a bearing 123 provided with a pneumatic cylinder 124 is fastened to the supporting bracket 122. On the other hand, attached to the under surface of the guide member 120 are a couple of brackets 125, 126 between which is put a shaft 127 that is passed through the bearing 123 slidably. A piston 124*a* of the pneumatic cylinder 124 is joined to one 125 of the brackets, whereby the guide member 120 can be moved in the same direction as the shaft 127, as the pneumatic piston 124*a* makes a stroke. That is, when the piston is pushed out, the guide member 120 is advanced to a position shown by a chain line from the original position shown by a solid line in FIG. 1, with the result that the top of the guide member is taken near the mouth of the suction pipe 35 which is then advancing toward the position I of the toe part sewing machine T. Reversely, when the piston 124*a* is withdrawn, the guide member 120 is brought back to the original position, with the result that the top of the guide member gets away from the suction pipe.

Figure 4A:
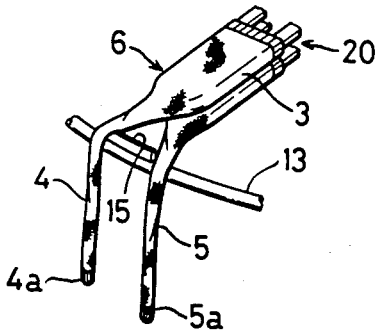
Figure 4B:
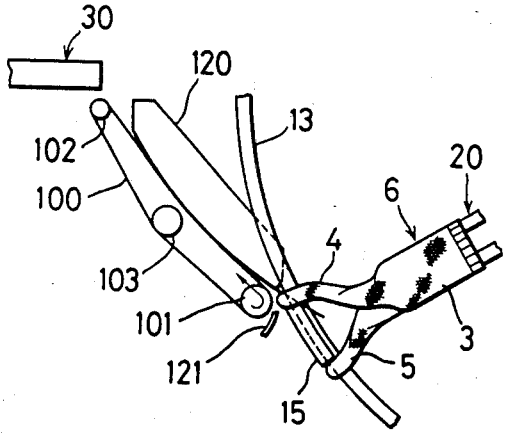
Figure 4C:
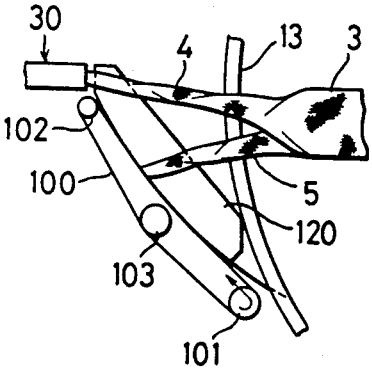
Figure 4D:
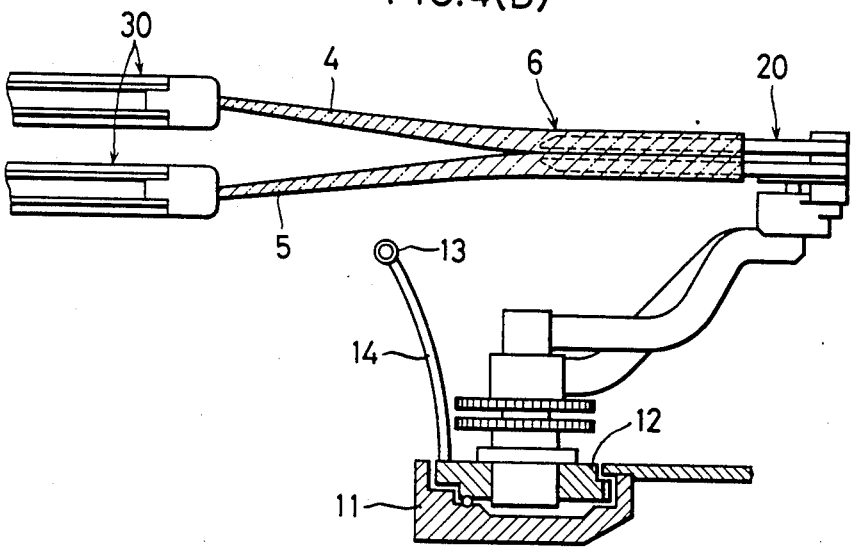

With referrence to FIGS. 4(A) to (D), the action of the apparatus of this example will be described in detail. A pair of half made pantyhose 6 whose panty part 3, including crotch part and front and back sides, has been seamed up by the panty part sewing machine travels from the station E to F as shown in FIG. 4(A), At this moment, the panty part 3 is held by a pair of upper and lower clipping plates of the clipping member 20, while the leg parts 4, 5 are dangling from the guide pipe 13, separated each by the separator 15. More specifically, one 4 of the leg parts, clipped by the upper plate, is put ahead and the other 5, clipped by the lower plate, is put behind on the guide pipe 13 with the separator put between them. Under the condition, the leg part 4 first comes near the V-shaped opening formed between the guide member 120 and the belt conveyor 100, guided by a curved end of the guide member. At this time, compressed air jets from the air jet nozzle 121 and the belt conveyor 100 begins to turn in the arrow-headed direction (c) by the actuation of the motor 105, whereby the dangling leg part 4 is held by the cooperative action of the belt conveyor and the guide member and compulsorily taken to the other end of the guide member. Namely, the leg part 4 is carried by the belt conveyor 100 with one side thereof sliding on the guide member 120. Therefore, the guide member is desirable to be touched to the belt conveyor rather lightly; if they otherwise strongly touch each other, the leg part is caused to slip on the guide member. In order to prevent such slipping of the leg part, it is recommendable to give the conveyor is toothed belt. With this device, one side of the leg part is engaged with the teeth of the conveyor's belt, so that the slipping can be avoided for sure. In this respect, according to this invention, both the sides of the conveyor's belt and the three puleys 101, 102, 103 can be toothed at the same time, whereby the slipping of the belt on the puleys is also prevented.

Anyway, when the leg part 4 arrives at the other end of the conveyor, the guide member 120 is pushed ahead of the conveyor by the action of the pneumatic cylinder 124, which makes the top of the guide member close to the mouth of the suction pipe 35, approaching to the position I of the toe part sewing machine. Hence, the leg part, having been carried to the terminal of the conveyor, is received for a moment by the top of the guide member and then sucked into the suction member 30 just coming there. The suction member, having sucked the leg part 4, heads for the next position II; after the suction member leaves the position I, the next one is transferred there.

At this moment, the leg part 5, lagging behind the leg part 4, is in the course of traveling, put between the belt conveyor 100 and the guide member 120. When the leg part 5 is conveyed to the other end of the belt conveyor, it rests on the top of the guide member for a little while and is sucked into the suction member 30, having just come there.

When both the leg parts 4, 5 are held by the suction members separately in tandem, the guide member 120 is withdrawn and brought back to the original position; at the same time, the turning of the belt conveyor is also stopped. In this way, one cycle of delivering comes to an end. Meantime, both the suction members 30, 30, having sucked a pair of leg parts, stop at the position I and II and the clipping member 20, still holding the panty part, stops at the station F for some while, where the clipping member 20 sets free the panty part 3 and then a pair of holders 51, 51, provided to the delivering member R, receive, turn inside out and deliver it to the toe part sewing machine T, covering its suction members therewith.

We claim:

1. In an integrated pantyhose sewing machine comprising a panty part sewing machine provided with a plurality of clipping members which seams a pair of hose together up to a pair of half made pantyhose before the clipping members, clipping the hose, finish a round-trip on a given closed path, a toe part sewing machine provided with a plurality of suction members which seams both the toe parts of said half made pantyhose up to a complete product before the suction members finish a round-trip on a given closed path, and a delivering member that delivers said half made pantyhose from said clipping member to said suction members, which is disposed on junction of said panty part sewing machine and said toe part sewing machine, a conveyor for use in carrying leg parts of said half made pantyhose, which is characterized in that a belt conveyor is disposed close to where the delivering is made in such a way that one end thereof is located close to where said clipping members bring said half made pantyhose with dangling leg parts; the other is located close to where suction members stop and that a guide member is disposed so closely as to touch to the surface of said belt conveyor in order that said leg parts of said half made pantyhose may be held and carried by said belt conveyor to where said suction members stop so as to be delivered to said suction members.

2. A conveyor for use in carrying leg parts of half made pantyhose as claimed in claim 1, which is characterized in that a V-shaped opening is made at one end of said belt conveyor and said guide member and at least one air jet nozzle is disposed in the vicinity of said V-shaped opening so as to put dangling leg parts of said half made pantyhose therein.

3. A conveyor for use in carrying leg part of half made pantyhose as claimed in claim 1, which is characterized in that both the sides of said conveyor's belt are provided with teeth.

4. A conveyor for use in carrying leg parts of half made pantyhose as claimed in claim 1, which is characterized in that said guide member is supported in order that it may move back and forth in contact with said belt conveyor and may approach to or depart from said suction members coming to where the delivering is made.

* * * * *